United States Patent [19]

Hollingsworth

[11] 3,950,796

[45] Apr. 20, 1976

[54] ARTICLE OF FURNITURE

[75] Inventor: Gary R. Hollingsworth, Ottawa, Canada

[73] Assignee: Novel Furnishings Ltd., Ottawa, Canada

[22] Filed: Feb. 3, 1975

[21] Appl. No.: 546,703

[52] U.S. Cl. ..... 5/2 R; 5/9 R; 297/118

[51] Int. Cl.[2] ..... A47C 13/38

[58] Field of Search ..... 5/2 R–8, 5/9 R, 93, 97; 312/117; 272/1; 46/13, 21; 297/118

[56] References Cited

UNITED STATES PATENTS

| | | | |
|---|---|---|---|
| 3,188,661 | 6/1965 | Rudy | 5/97 |
| 3,267,494 | 8/1966 | Bryant | 5/97 |
| 3,312,984 | 4/1967 | Haystrom | 5/9 R |
| 3,316,564 | 5/1967 | Rogers, Jr. | 5/9 R |
| 3,475,070 | 10/1969 | Hoshall | 312/117 |
| 3,638,246 | 2/1972 | Jewell | 5/9 R |

*Primary Examiner*—Casmir A. Nunberg

[57] ABSTRACT

A "Child's Cave" provides a small "living" enclosure in which a child can work or play. In this enclosure, a seat assembly faces a shelf that acts as a working surface. Access to the enclosure is provided by cut-outs in one or both of the front and rear walls. The wall panels also define a separate clothes storage space which can be closed to the exterior by a curtain. An upper bed extends along the top of the article to provide a main sleeping surface and form a ceiling for the living enclosure and clothes storage space. Climbing holes form a ladder to this bed. The article has the further features that (a) the seat assembly and shelf can be horizontally aligned to form a second, lower bed; (b) slidable drawers are located in the lower part of the clothes storage space; and (c) the climbing holes are spaced apart non-uniformly, the spacing between the uppermost pair being less than that between the other pairs.

14 Claims, 8 Drawing Figures

ARTICLE OF FURNITURE

This invention relates to a so-called "Child's Cave", that is to say an article of furniture that can serve the purpose of a small enclosure in which a child can work or play, while at the same time providing the child with other facilities such as a bed and one or more storage spaces for clothes, books, toys etc.

More specifically, the invention relates to an article consisting essentially of a. vertical wall panels defining an enclosure for occupancy by a child, b. an access passageway to the enclosure formed in at least one of the panels, c. a seat assembly in the enclosure, d. a shelf forming a working surface disposed in the enclosure facing the seat assembly, e. a bed extending horizontally along an upper portion of the article to form a ceiling for the enclosure, f. and means for horizontally aligning the seat assembly and the shelf to form a second, lower bed for use by a child who is too young to be able safely to use the main, upper bed, thus significantly enhancing the versatility of the article.

Other features afforded by the preferred form of the present invention are the provision of a clothes storage space defined by the wall panels and the location of at least one slidable drawer in the clothes storage space, preferably in the lower part thereof, thus encouraging more complete utilisation of this space, as well as furnishing a convenient horizontal surface above the floor for the placing of articles of clothing such as shoes.

Climbling holes may be formed in one or both of the front and rear walls formed by the vertical wall panels to provide a ladder to the upper bed. An optional feature of the present invention is that the vertical spacing between these holes can be non-uniform, the spacing between the uppermost pair being less than that between the other pairs. This arrangement assists the child in climbing into, and especially climbing out of, the upper bed.

A preferred embodiment of the present invention is illustrated by way of example in the accompanying drawings. It is to be understood that the broad scope of the invention is not limited by the details illustrated but is defined in the appended claims.

IN THE DRAWINGS

FIG. 1 is a front elevation view of the article;

FIG. 2*a* is a vertical longitudinal section taken down the center of the article, showing the parts in a first position;

FIG. 2*b* is a view similar to FIG. 2*a*, showing the parts in a second position;

FIG. 3*a* is a section on the line IIIa—IIIa in FIG. 2*a;*

FIG. 3*b* is a section on the line IIIb—IIIb in FIG. 2*b;*

Figure 1:
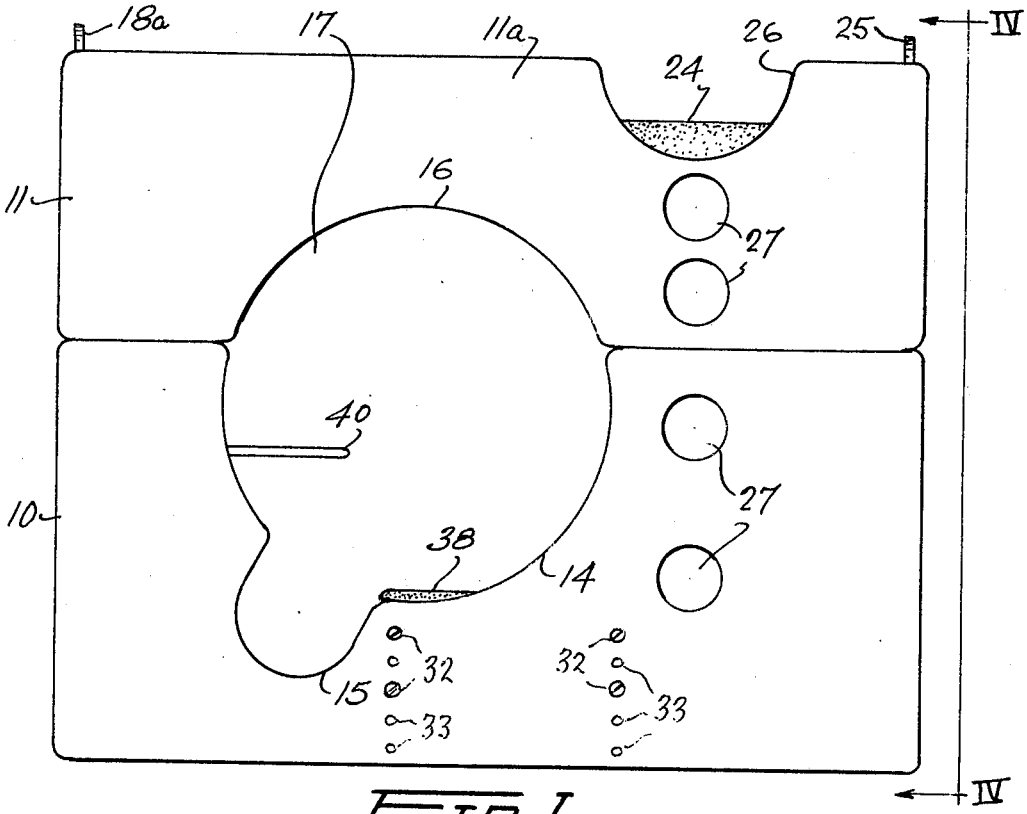

The article will be seen to have a front wall formed from a lower panel 10 and an upper panel 11, and a rear wall formed from a lower panel 12 and an upper panel 13. Cut-outs 14, 15 and 16 formed in these wall panels form passageways 17 providing access to the interior of the article. While it is preferred for the purpose of making the article reversible and hence more versatile to provide an access passageway 17 in both the front and rear walls, a single such passageway in one of these walls would provide the necessary access, in which case the other wall panels would be uninterrupted by the cut-outs 14 to 16.

Figure 2A:
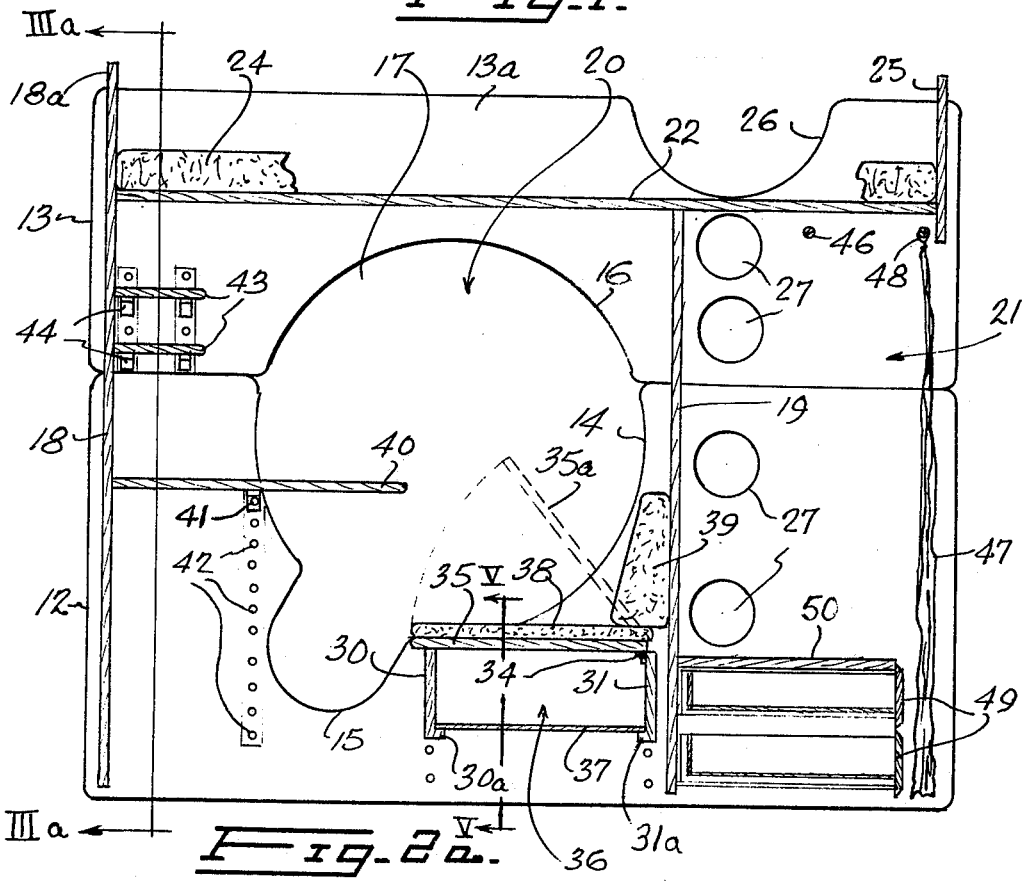

With reference primarily to FIG 2*a*, there will be seen to be a vertical, transverse panel 18 provided at one end of the article to define an end wall, and a second transverse, divider panel 19 that separates the article into a "living" enclosure 20 and a clothes storage space 21. A ceiling to these spaces is formed by a horizontal transverse panel 22 which forms a bed on which a mattress 24 can be laid. The sides of this bed are defined by upper portions 11*a* and 13*a* of the wall panels 11 and 13 and its ends are defined by an upper portion 18*a* of the panel 18 and a shallow, transverse panel 25 provided at the upper part of the other end of the article, the panel 25 and the panel portion 18*a* projecting slightly above the top edges of the side wall portion 11*a* and 13*a*. Easy access to the bed is afforded by cut-outs 26 in the panel portions 11*a* and 13*a* and climbing holes in the panels 10 to 13 form a ladder leading to the bed. If the article is to be one-sided, rather than reversible, the cut-out 26 and holes 27 need only be provided in one of the front and back walls. It will be noted that the spacing between the two upper holes 27 is less than between other pairs of adjacent holes, which is convenient for a child when climbing in or out, especially out, of the bed.

The enclosure 20 is provided with a seat assembly that consists basically of a pair of transverse, vertical panels 30 and 31 that are secured to the lower panels 10 and 12 by means of bolts 32. The height of the seat can be varied by inserting these bolts 32 in different holes, such as those shown at 33. The transverse panel 31, which is positioned closely adjacent the divider panel 19, carries a hinge 34 that pivotally mounts a pair of lids 35 each of which is independently movable between an upwardly tilted open position such as shown at 35*a* in FIG. 2*a* and a lowered horizontal position to form a seat. This raising of either seat 35 provides access to a "toy box" storage space 36, the bottom of which is formed by a horizontal panel 37 that rests on ridges 30*a* and 31*a* projecting inwardly along the lower edges of the panels 20 and 31. If preferred, one of the seats 35 can be fixed, only the other being in the form of a hinged lid. Cushions 38 are provided on the seats 35 and either a single or a divided bolster 39 forms a suitable back rest to the seat assembly.

Figure 6:
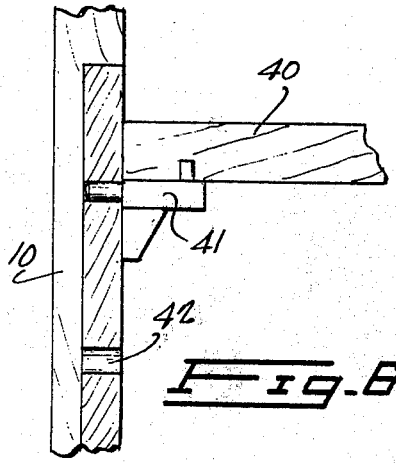
FIG. 6 is a fragmentary view showing a manner of mounting certain of the parts.

A large shelf 40 that can serve the function of a table or work surface is supported between the front and rear lower panels 10 and 12 as well as by the end panel 18. The shelf 40 will be supported by dowels (not shown) that project from the shelf 40 into holes 40*a* formed in the inwardly facing surface of the panel 18 and by support brackets 41 that engage holes 42 formed in the inwardly facing surface of the panels 10 and 12, as shown in detail in FIG. 6. Choice of which holes 40*a* and 42 to use will enable the shelf 40 to be mounted at different heights. In a similar manner, smaller shelves 43 which can serve as book shelves or as a storage facility for other small articles extend between the upper wall panels 11 and 13, being vertically adjustably mounted thereon by means of similar brackets 44.

Figure 2B:
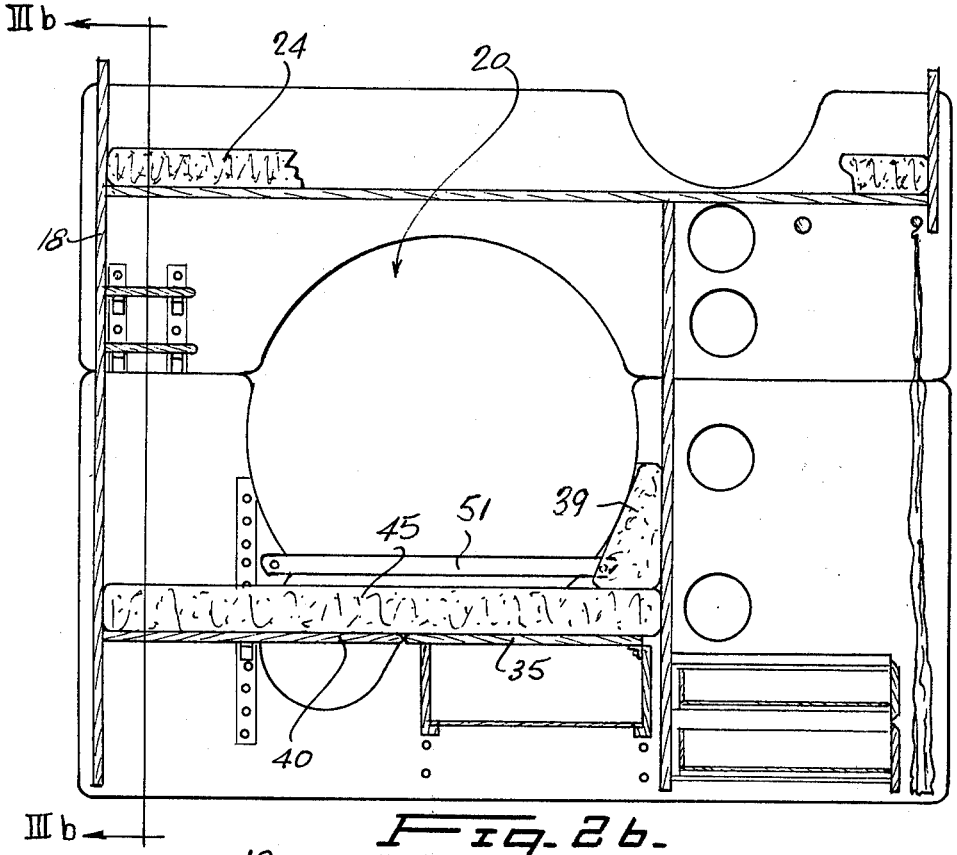
Figure 3A:
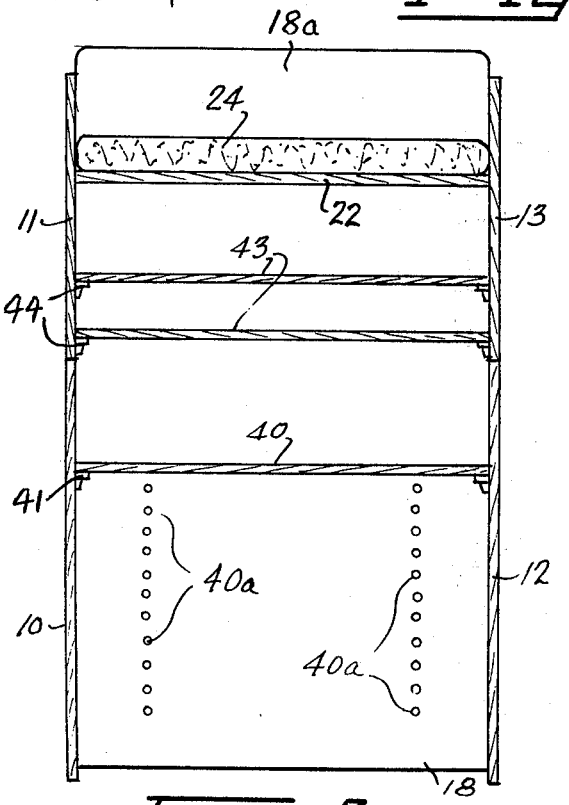
Figure 3B:
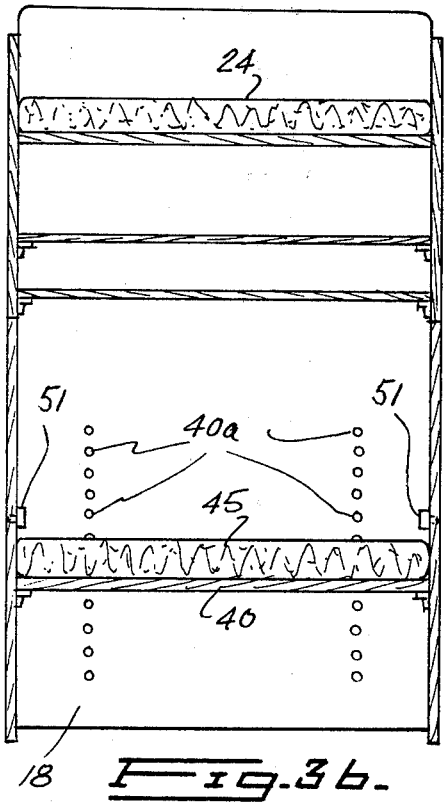
Figure 4:
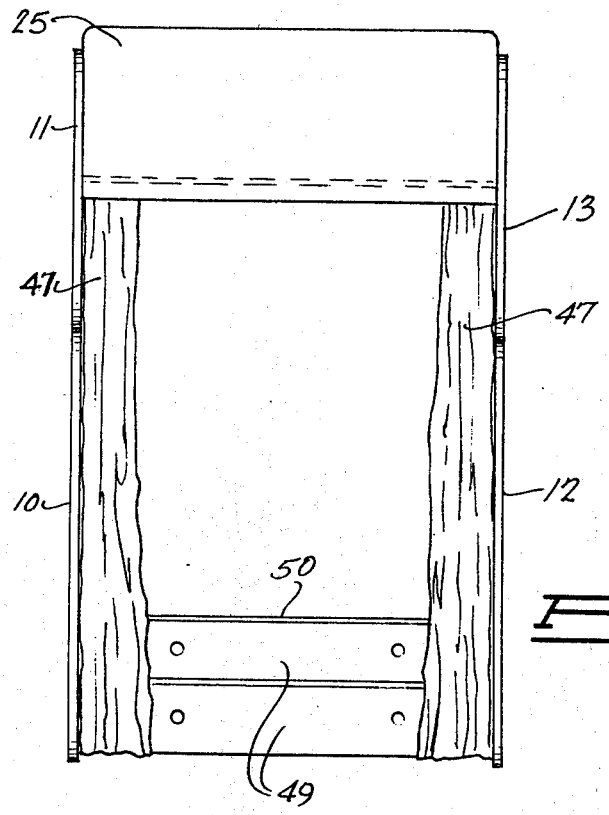
FIG. 4 is an end view on the line IV—IV in FIG. 1.
Figure 5:
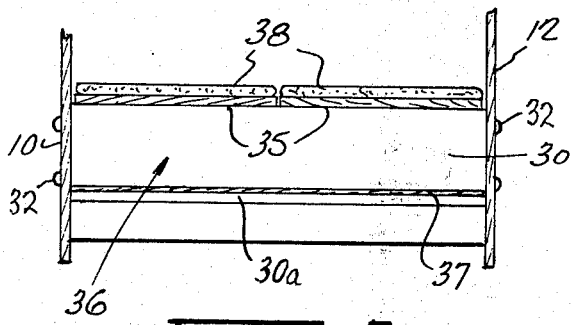
FIG. 5 is a fragmentary section on the line V—V in FIG. 2*a;*.

As demonstrated by FIGS. 2*b* and 3*b*, the shelf 40 can be lowered to the same level as that of the seats 35 to provide a second bed on which the cushions 38 can be replaced by a mattress 45. The bolster 39 can either be retained, or dispensed with, as desired. Side rails 51 can be added, if desired, being secured by press-fit plugs into the inside surfaces of the panels 10 and 12. This provision of a lower bed renders the article extremely versatile. When an infant has grown too old to sleep in a crib, he is still too young to sleep in the upper bed. The lower bed is suitable for the child until he is old enough to graduate to the upper bed, at which time the enclosure 20 can be used for its primary function, i.e. as a living space for work and play.

Alternatively, both beds can be used simultaneously to accommodate two children.

The clothes storage space 21 contains a transverse rod 46 for receiving clothes hangers. This space can be closed to the exterior by means of a pair of curtains 47 movable on a curtain rod 48. The lower portion of the storage space 21 is occupied by a pair of slidable drawers 49, the upper surface 50 of which provides a convenient surface for receiving shoes or similar articles. If desired, small fixed curtains (not shown) can be draped down the portions of the inside surfaces of the wall panels behind the holes 27 to prevent the interior of the clothes storage space 21 being visible from the exterior through these holes.

It is believed that the utilization of the article will be largely apparent from the foregoing. The child can work and play in the enclosure 20 using the shelf 40 in its FIG. 2*a* position, sleep in the upper bed and store clothes in the storage space 21, further storage space being provided by the toy box space 36. Access to this space can be gained by lifting one of the hinge seats 35 while sitting on the other. It is thus not necessary for the user to step out of the article to use the space 36. Alternatively, as already explained the enclosure 20 can be used primarily to provide space for a lower bed.

The article is relatively easy to erect and will therefore be capable of shipping and sale in a knocked-down condition for subsequent erection by the purchaser in the home. The various adjustable features permit the parent to accommodate the article to the growth of a child or to children of different ages.

I claim:

1. An article of furniture comprising a. vertical wall panels defining an enclosure for occupancy by a child, b. an access passageway to said enclosure formed in at least one of said panels, c. a seat assembly in said enclosure, d. a shelf forming a working surface disposed in said enclosure facing said seat assembly, e. an upper bed extending horizontally along an upper portion of the article to form a ceiling for said enclosure, and f. means for adjusting the height of said shelf relative to said vertical wall panels to align the shelf horizontally with the seat assembly to form therewith a second, lower bed shorter than the upper bed.

2. An article accoding to claim 1, including a clothes storage space defined by said vertical panels, said upper bed forming a ceiling for said clothes storage space.

3. An article according to claim 2, wherein said clothes storage space is separated from said enclosure by a said vertical wall panel, an access opening to said clothes storage space being provided from the exterior of the article.

4. An article according to claim 2, including at least one slidable drawer located in said clothes storage space.

5. An article according to claim 4, wherein said drawer is located in a lower part of said space to provide a horizontal surface for receiving articles of clothing.

6. An article according to claim 1, wherein said seat assembly comprises g. further panels defining a box structure for use as a storage space, and h. a pair of seats, at least one of which is in the form of a hinged lid movable between a horizontal position and an open position providing access to said storage space, i. said seats being arranged side by side to enable one to be used as a seat while the other is lifted to gain access to said storage space.

7. An article according to claim 1, including means for adjusting the height of said seat assembly relative to said vertical wall panels.

8. An article according to claim 1, including at least one vertical series of climbing holes in said wall panels forming a ladder to said upper bed.

9. An article according to claim 8, wherein the vertical spacing between an uppermost pair of said holes is less than the vertical spacing between other pairs of said holes.

10. An article according to claim 9, including a cut-out formed in a said wall panel above said series of climbing holes to improve access to the upper bed.

11. An article according to claim 10, wherein a said series of climbing holes and a said cut-out are provided in opposite walls formed by said vertical wall panels whereby to render the article reversible.

12. An article according to claim 1, wherein two such access passageways are provided in opposite side walls formed by said vertical wall panels whereby to render the article reversible.

13. An article according to claim 1, including at least one further shelf disposed in said enclosure above said working surface shelf to provide an additional storage facility.

14. An article according to claim 3, including movable curtain means for closing the access opening to the clothes storage space from the exterior.

* * * * *